US008934320B2

(12) United States Patent
Nakagawa

(10) Patent No.: US 8,934,320 B2
(45) Date of Patent: Jan. 13, 2015

(54) ELECTRONIC TIMEPIECE

(75) Inventor: Makoto Nakagawa, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 396 days.

(21) Appl. No.: 13/367,435

(22) Filed: Feb. 7, 2012

(65) Prior Publication Data

US 2012/0213040 A1 Aug. 23, 2012

(30) Foreign Application Priority Data

Feb. 22, 2011 (JP) ..... 2011-035317

(51) Int. Cl.

| | |
|---|---|
| ***G04C 17/00*** | (2006.01) |
| ***G04C 17/02*** | (2006.01) |
| ***G04G 9/00*** | (2006.01) |
| ***G04R 20/26*** | (2013.01) |

(52) U.S. Cl.

CPC ..... *G04G 9/0005* (2013.01); *G04R 20/26* (2013.01)

USPC ..... 368/47; 368/66; 368/67; 368/227

(58) Field of Classification Search

USPC ..... 368/10, 46, 47, 66–68, 227

See application file for complete search history.

(56) References Cited

U.S. PATENT DOCUMENTS

| | | | | |
|---|---|---|---|---|
| 3,760,582 | A * | 9/1973 | Thiess et al. | 368/239 |
| 4,238,793 | A * | 12/1980 | Hochstrate | 345/102 |
| 5,886,953 | A * | 3/1999 | Kawahara et al. | 368/66 |
| 6,829,494 | B2 * | 12/2004 | Tanabe | 455/574 |
| 7,050,037 | B1 * | 5/2006 | Kuramatsu | 345/102 |
| 2002/0171400 | A1 * | 11/2002 | Koyama et al. | 320/135 |
| 2006/0160488 | A1 | 7/2006 | Sueoka et al. | |

FOREIGN PATENT DOCUMENTS

| | | |
|---|---|---|
| JP | 2000-031850 | 1/2000 |
| JP | 2006-197510 | 7/2006 |
| JP | 2007-300154 | 11/2007 |
| WO | 02073770 | 9/2002 |

OTHER PUBLICATIONS

Online (Google) Translation of JP2007-300154, retrieved from the internet May 3, 2014.*

Japanese Office Action for Japanese Application No. 2011-035317 mailed on Nov. 27, 2012.

Japanese Office Action for Japanese Application No. 2011-035317 mailed on Sep. 10, 2013.

* cited by examiner

*Primary Examiner* — Vit W Miska

(74) *Attorney, Agent, or Firm* — Amin, Turocy & Watson, LLP

(57) ABSTRACT

An electronic timepiece includes: a timekeeping section which counts time; a time display section which displays time; an illuminating section which performs illumination; a wireless communication section which performs wireless communication by transmitting/receiving a wireless signal intermittently; and a drive control section which performs duty drive of the illuminating section when a period in which wireless communication is conducted by the wireless communication section and a period in which the illuminating section is driven overlap with each other.

6 Claims, 4 Drawing Sheets

ELECTRONIC TIMEPIECE

BACKGROUND OF THE INVENTION

1. Field of the Invention

The present invention relates to an electronic timepiece provided with a wireless communication section.

2. Description of Related Art

A timepiece has been developed which is equipped with a wireless communication function such as Bluetooth (registered trademark) and is able to have wireless communication with a mobile phone and the like.

Also, an electronic timepiece is typically provided with an illumination device for illuminating a display section or outside and the illumination device is driven by pushing an illumination button.

Further, as a related art of the invention of this application, Japanese Patent Application Laid-Open Publication No. 2006-197510 (corresponding to US 2006/0160488 A1) disclosed a technique in an apparatus which conducts near field wireless communication to drive a light-emitting diode so as to flash during the communication to notify outside that the apparatus is currently conducting the communication.

In an electronic timepiece driven by a small battery, a response performance of a power source with respect to a large load is relatively low. Therefore, when there is a plurality of operations each consuming a large current, it is necessary to prevent such operations from being carried out simultaneously. For instance, transmitting/receiving a wireless signal and driving an illumination device are operations each requiring a large amount of current, and it is necessary to prevent these operations from being carried out at the same time.

Given such situation, the inventor of this invention has conducted studies on a control when wireless communication and illumination driving are carried out in the same period. This control is for stopping driving of an illumination device in a very short period, in which a radio frequency (RF) circuit is activated and a wireless signal is actually transmitted/received, during a wireless communication period. During the communication period, an actual transmission/receipt period of a wireless signal is as short as, for example, 3 millisecond (ms) per second, so it was expected that stopping driving of the illumination device during the transmission/receipt period does not cause a problem.

However, it was found that a human senses with eyes a light-off period as light flicker, even in the case that the period is 3 ms and would not be recognized as blinking by human eyes if the period occurs in a very short cycle, when this very short light-off period occurs in a relatively long cycle during continuous lighting of the illumination device.

This means that, when wireless communication and illumination driving are carried out in the same period, if a control for stopping driving of the illumination device is carried out only for a very short period in which the RF circuit is activated and a wireless signal is actually transmitted/received during the communication period, a user senses illumination flicker occurring in a relatively long cycle, and such illumination flicker brings discomfort to the user.

The present invention provides an electronic timepiece which can avoid illumination flicker bringing discomfort to a user, even when performing a control for preventing large loads from overlapping when wireless communication and illumination driving are carried out in the same period.

BRIEF SUMMARY OF THE INVENTION

According to one aspect of the present invention, there is provided an electronic timepiece including a timekeeping section which counts time, a time display section which displays time, an illuminating section which performs illumination, a wireless communication section which performs wireless communication by transmitting/receiving a wireless signal intermittently, and a drive control section which performs duty drive of the illuminating section when a period of wireless communication conducted by the wireless communication section and a period of driving the illuminating section overlap.

BRIEF DESCRIPTION OF THE SEVERAL VIEWS OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE INVENTION

An embodiment of the present invention will be explained below based on the drawings.

Figure 1:
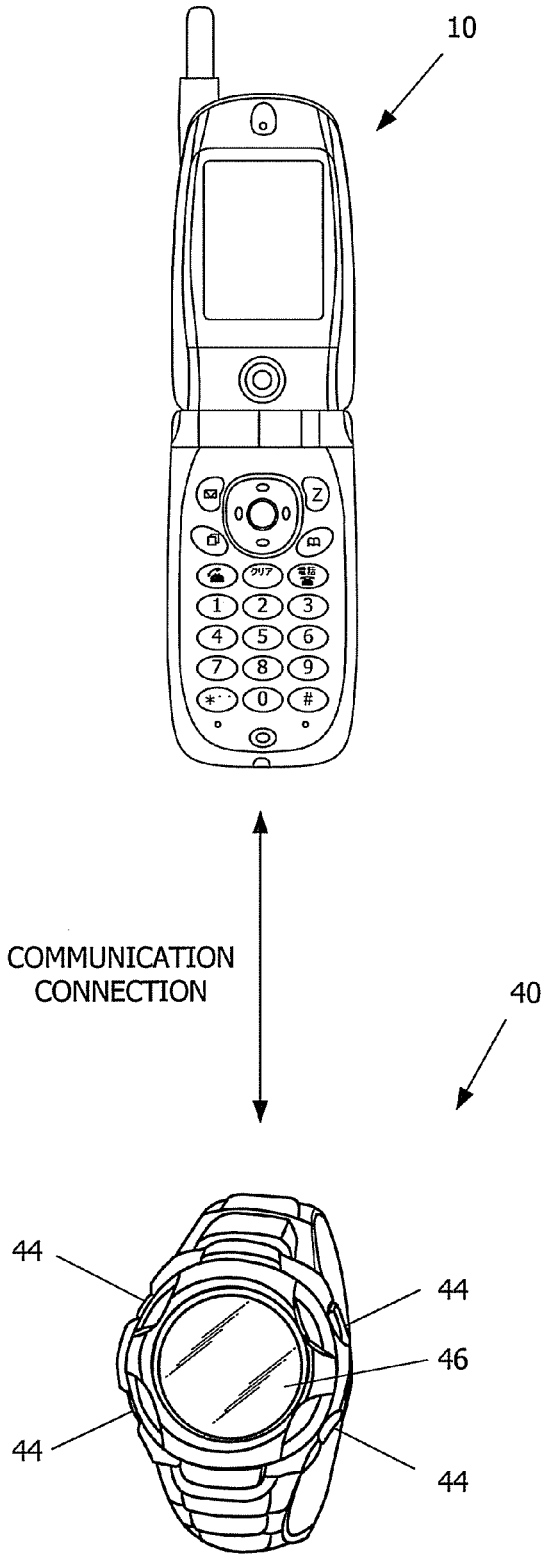
FIG. 1 is a diagram showing an example of a system configuration in which an electronic timepiece according to an embodiment of the present invention is included.
Figure 2:
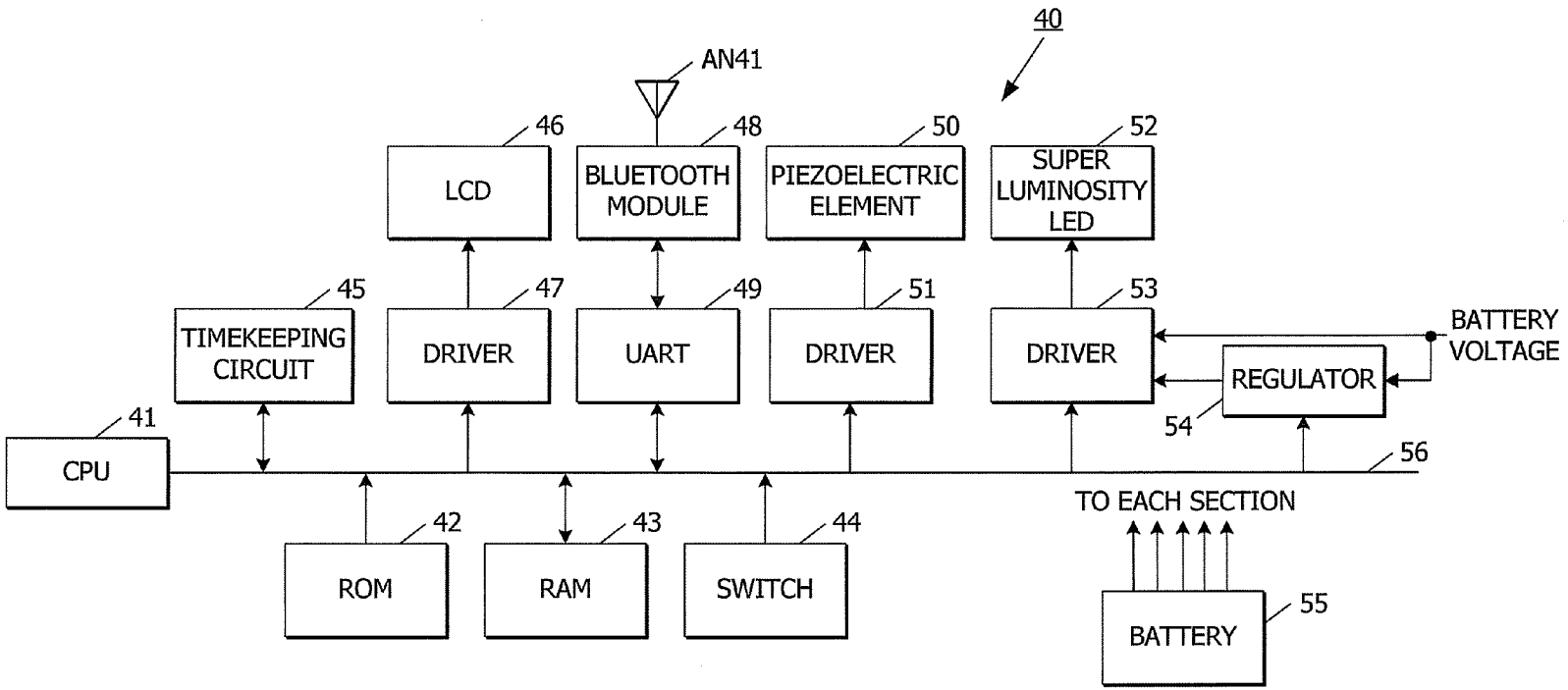
FIG. 2 is a block diagram showing an overall configuration of the electronic timepiece of the embodiment.

FIG. 1 is a diagram showing an example of a system configuration in which an electronic timepiece according to an embodiment of the present invention is included, and FIG. 2 is a block diagram showing an overall configuration of the electronic timepiece of the embodiment.

An electronic timepiece 40 of this embodiment is a timepiece which is wearable by a user, such as a wrist watch, and has a configuration enabling data communication with other electronic device with Bluetooth wireless communication function. As illustrated in FIG. 1, a mobile phone 10 is used as a communication counterpart in this embodiment. A wireless communication system employed is a communication system of a low-power consumption mode in which a timing and period for transmitting/receiving a wireless signal are set to a short period in a long cycle such as 3 millisecond (ms) per second. With this communication system of the low-power consumption mode, an operation for transmitting/receiving a wireless signal which consumes a relatively large current can be carried out only for a short period in a long cycle, thus greatly reducing a total amount of power consumption required for wireless communication.

As shown in FIG. 2, the electronic timepiece 40 includes a central processing unit (CPU) 41 which performs overall control of the device, a read-only memory (ROM) 42 which stores control programs executed by the CPU 41 and control data, a random access memory (RAM) 43 which provides the CPU 41 with a working memory space, a switch 44 serving as an operating section which receives a command from outside, a timekeeping circuit 45 serving as a timekeeping section which counts current time data, an liquid crystal display section (LCD) 46 serving as a time display section which displays time and various other types of information, a driver 47 which drives the liquid crystal display section 46, a Bluetooth module 48 serving as a wireless communication section which performs near field wireless communication via an antenna AN 41, an universal asynchronous receiver transmitter (UART) 49 which performs data processing such as serial-parallel conversion for data transmitted/received via the Bluetooth module 48, a piezoelectric element 50 which notifies a user with buzzer sound, the driver 51 thereof, a light-emitting diode (super luminosity LED) 51 serving as an illuminating section, a driver 53 thereof, a regulator 54 which generates a second driving voltage for the light-emitting diode 52, a battery 55 which supplies each section with an operating voltage, a bus 56 which allows the CPU 41 and each section to exchange signals, and the like.

The light-emitting diode 52 emits light and illuminates the liquid crystal display section 46 and outside, and is formed of, for example, a super luminosity LED. In this embodiment, the light-emitting diode 52 is driven and lighting operation is conducted when a user inputs an illumination request by operating a light-emitting button of the switch 44. A driving system for the light-emitting diode 52 will be described later.

The regulator 54 reduces a voltage of the battery 55 and supplies the driver 53 with the second driving voltage for the light-emitting diode 52 when the light-emitting diode 52 is driven for continuous illumination.

The battery 55 is either a button-type primary or secondary battery, and a response performance thereof with respect to a large load is relatively low. For instance, when an operation for transmitting/receiving a wireless signal by the Bluetooth module 48 and driving of the light-emitting diode 52 happen at the same time, the voltage of the battery 55 could be relatively unstable, and such unstableness needs to be avoided.

The Bluetooth module 48 performs communication connection with a given mobile phone 10 and carries out various data communications with the communication system of the low-power consumption mode. The Bluetooth module 48 has an analog circuit such as an RF circuit which transmits/receives a wireless signal, and consumes a relatively large amount of power as the circuit is activated.

In each of the mobile phone 10 and the electronic timepiece 40, communication setting processing (or pairing) is done in advance so that the mobile phone 10 and the electronic timepiece 40 can have communication connection to each other via the Bluetooth module 48. When the mobile phone 10 and the electronic timepiece 40 are brought close to each other in an area where a wireless signal can be transmitted, they enter into a connected state for communication to each other automatically or semi-automatically in response to an operation for the connection. Then, communication in the low-power consumption mode begins. When the mobile phone 10 and the electronic timepiece 40 are brought away from each other to an area where a wireless signal is not transmitted, communication connection therebetween is automatically canceled and the operation of transmitting/receiving a wireless signal by the Bluetooth module 48 of the electronic timepiece 40 is suspended until the next request for communication connection is made.

With the Bluetooth communication described above, various linkage functions which link the mobile phone 10 and the electronic timepiece 40 can be realized. For example, incoming call or incoming email information of the mobile phone 10 is sent from the mobile phone 10 to the electronic timepiece 40 and a user is notified by the electronic timepiece 40 of the information regarding the incoming.

The ROM 42 stores various programs as control programs executed by the CPU 41 of the electronic timepiece 40, including a timepiece mode processing which displays time and performs an alarm operation at a set time in accordance with timekeeping data of the timekeeping circuit 45, an operation input processing which executes operations in response to operation commands inputted by operating the switch 44, a communication-related processing which controls Bluetooth communication connection and executes various linkage operations with the mobile phone 10, and an illumination driving processing which controls illumination driving in response to an operation to turn on the illumination. The program for the illumination driving processing and the CPU 41 which executes the program constitute a drive control section.

[Illumination Driving Processing]

Next, illumination driving operations in the electronic timepiece 40 with the aforementioned configuration will be explained.

Figure 3A:
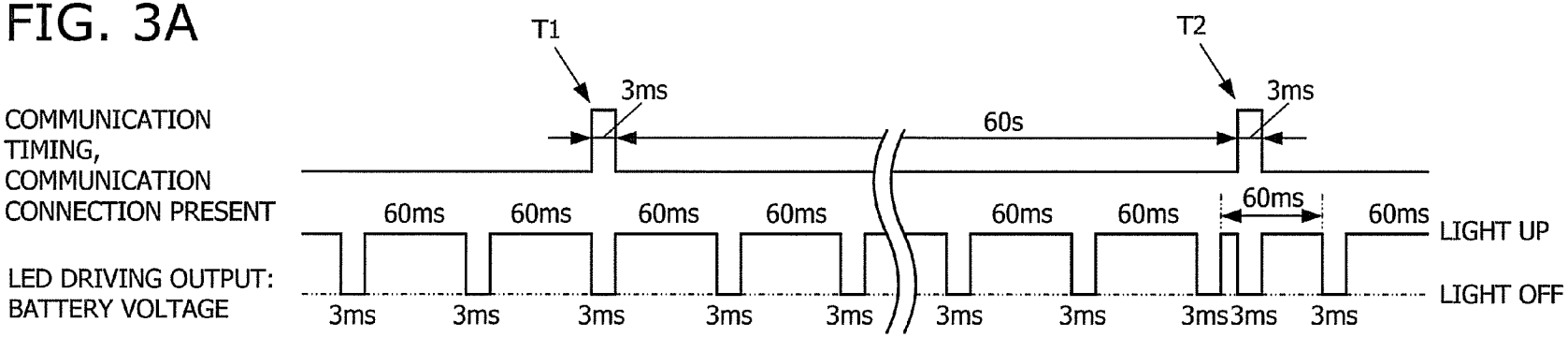
FIGS. 3A and 3B are time charts explaining a relationship between wireless communication and illumination driving.
Figure 3B:
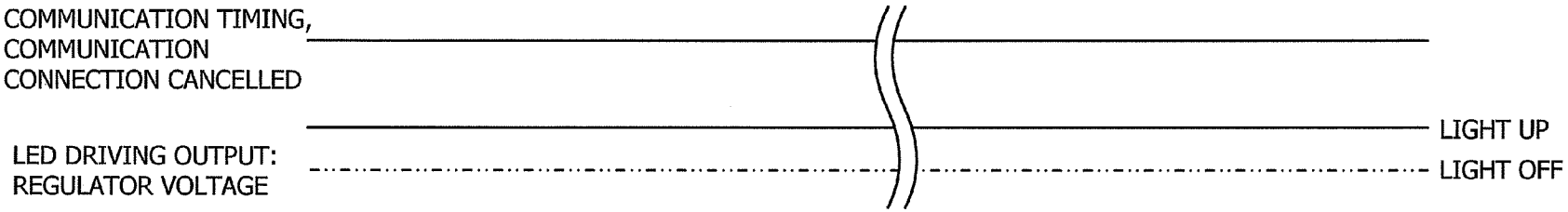

FIGS. 3A and 3B show time charts describing a relation between wireless communication and illumination driving. FIG. 3A shows communication timings (timings of transmitting/receiving a wireless signal) in a state where a communication connection is established, and a driving output of the light-emitting diode 52. FIG. 3B shows a communication timing in a state where communication connection is canceled, and a driving output of the light-emitting diode 52.

Although not particularly limited, in the electronic timepiece 40 of this embodiment, the light-emitting diode 52 is continuously driven for a predetermined period (for example 15 seconds) after a request for driving illumination is made by a user by operating the illumination button of the switch 44. A driving system for the light-emitting diode 52 is switched among a plurality of types of systems depending on an operating state of the Bluetooth module 48 as described below.

First, as shown in FIG. 3A, when the Bluetooth module 48 is in a communication connection state while illumination is driven, a control is conducted to stop driving of the light-emitting diode 52 at communication timings of the Bluetooth module 48 as illustrated as timings T1 and T2, that is, during periods in which the RF circuit of the Bluetooth module 48 is activated and a wireless signal is transmitted/received. Due to this control for stopping driving of the illumination, communication timings and driving periods of the light-emitting diode 52 are prevented from overlapping, thus preventing a load on the battery 55 from being too large temporally.

Further, when the Bluetooth module 48 is in a state where communication connection is established, the light-emitting diode 52 is duty-driven (driven so as to be turned on and off repeatedly in a short cycle) throughout the illumination driving period.

Here, the voltage of the battery 55 is applied as it is as the drive voltage, and the duty-drive cycle is set to a 63-ms cycle and the duty ratio thereof is set to 20:1 as an on-off ratio, for example. The duty-drive cycle and duty ratio may be changed as appropriate. For instance, the cycle may be set so that human eyes cannot completely recognize on and off states of lighting, or the ratio of the off period may be set higher as long as the drive voltage is high enough to easily get a desired amount of luminescence.

As shown in FIG. 3A, it is recommended that the off period of duty drive be set to the same or longer than the period (for example, 3 ms) in which driving of the light-emitting diode 52 is stopped at communication timings. Because of this setting, even when performing a control for stopping driving of the light-emitting diode 52 at communication timings, the operation for stopping the illumination driving is blended into on-off operations of the duty drive, and is difficult to be recognized by human eyes. However, the off period of the duty drive is not necessarily be the same as or longer than the period for stopping driving of the light-emitting diode 52. Even if the off-period is set shorter than the aforementioned period, the operation for stopping driving of the light-emitting diode 52 at communication timings is hidden in the on-off operations of the duty drive, and can be hard to be recognized.

Further, the communication timing cycle in the low-power consumption mode is controlled precisely to a constant cycle without variation. Therefore, a control for synchronizing the communication timing cycle and duty drive cycle of the light-emitting diode 52 can and may be conducted so that the communication timings always overlap the off-period of the duty cycle. With such control, there is no period for turning off the light-emitting diode 52 except for on-off period of duty drive, so uncomfortable flickering of light is even harder for a user to recognize.

The values for the duty drive cycle and on-off periods thereof may be selected as appropriate in accordance with the period for stopping driving of the light-emitting diode 52 at communication timings. Hence, appropriate values may be selected so that no uncomfortable flickering of illumination is recognized.

Next, as shown in FIG. 3B, when the communication connection of the Bluetooth module 48 is cancelled while the illumination is driven, the light-emitting diode 52 is driven to continue lighting. During the continuous lighting, a voltage obtained by reducing the voltage of the battery 55 by the regulator 54 is used as the drive voltage so that brightness of the illumination is controlled to be substantially the same as the brightness of the same when the illumination is duty-driven as shown in FIG. 3A.

Even when the Bluetooth communication connection is cancelled, the light-emitting diode 52 may also be duty-driven so that the driving pattern of the illumination remains substantially the same regardless of communication connection.

[Control Steps]

Figure 4:
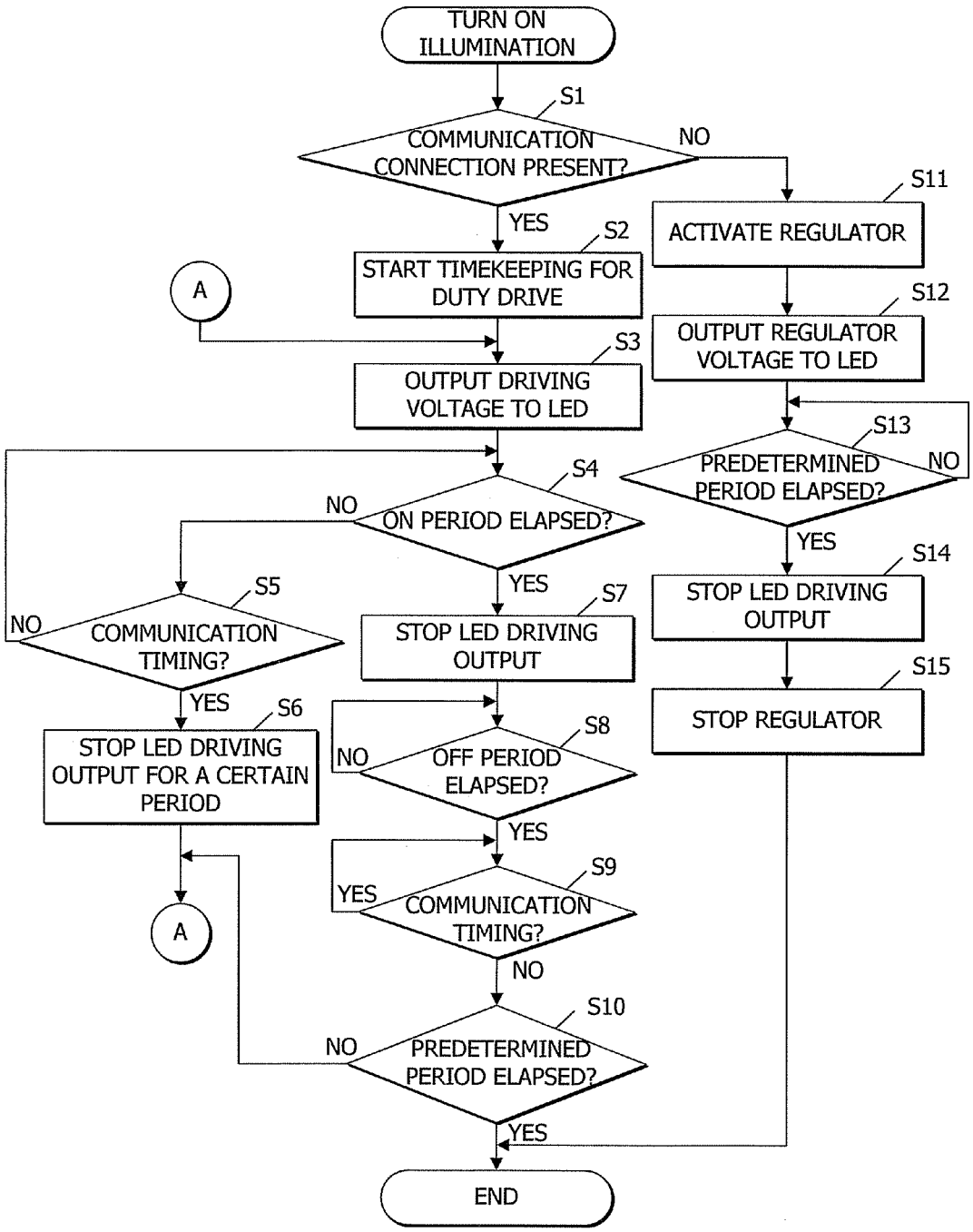
FIG. 4 is a flowchart showing a control procedure of illumination driving processing executed by a CPU.

FIG. 4 shows a flowchart of illumination driving processing executed by the CPU 41 based on the operations for turning on the illumination.

The aforementioned operations for driving the illumination are realized by the control steps shown in FIG. 4. Specifically, when the illumination is turned on and the processing is moved to driving of the illumination, the CPU 41 first confirms the state of the Bluetooth module 48 and determines whether the Bluetooth module 48 is currently in communication connection (step S1). When the Bluetooth module 48 is in communication connection, the CPU 41 begins timekeeping for duty drive (step S2), and also outputs an on signal to the driver 53 to start outputting of a drive voltage to the light-emitting diode 52 (step S3).

Next, the CPU 41 determines whether the on period (for example, 60 ms) of the duty drive has elapsed based on the timekeeping data for duty drive (step S4). When the on period is not yet elapsed, the CPU 41 determines whether it is a communication timing of the Bluetooth module 48 (timing at which the RF circuit is activated and a wireless signal is transmitted/received) (step S5), and when it is not the communication timing, the processing returns to step S4. This means that when the on period of duty drive is not elapsed and it is not communication timing, the determination processing of steps S4 and S5 are repeated while the light-emitting diode 52 continues to be driven.

On the other hand, when the processing of the step S5 determines that it is communication timing, the CPU 41 outputs an off signal to the driver 53 and stops driving of the light-emitting diode 52 for a certain period (step S6). The period for stopping is equal to a length of time (for example, 3 ms) in which a wireless signal is transmitted/received. Then, after the stopping period, the processing returns to step S3.

While the above-mentioned light-emitting diode 52 stays driven, when the on period of the duty drive is elapsed, the processing moves on to "Yes" at the determination process of step S4. In this case, the CPU 41 first outputs an off signal to the driver 53 to stop driving of the light-emitting diode 52 (step S7).

Then, the CPU 41 stands by until the off period of the duty drive (for example, 3 ms) is elapsed based on the timekeeping data for duty drive (step S8). When the off period is elapsed, the CPU 41 determines whether the timing at which the off period is elapsed and the communication timing overlap (step S9). When the timing overlaps with the communication timing, then the processing moves on, but when the timing does not overlap with the communication timing, then the processing moves on after a period for transmitting/receiving a wireless signal is elasped.

Next, the CPU 41 determines whether a predetermined period (for example, 15 seconds) have elapsed since the illumination started being on (step S10). When the predetermined period is not elapsed yet, the processing returns to step S3 and the processing for driving the light-emitting diode 52 is repeated.

Thus, by repeating the loop of aforementioned steps S3 to S10, the duty drive of the light-emitting diode 52 is realized in which on and off are repeated in a short cycle. When the communication timing overlaps with the on period of the duty drive, a control is conducted to stop driving of the light-emitting diode 52 only for the period of the communication.

Then, when the predetermined period is elapsed in which illumination is continuously driven by repeating the duty drive control, it is determined that the predetermined period has elapsed in step S10, thus ending the illumination driving processing.

On the other hand, when it is determined in step S1 that there is not communication connection present, then the CPU 41 first activates the regulator 54 (step S11), outputs a control signal to the driver 53, and then allows the light-emitting diode 52 to output the voltage of the regulator 54 (step S12).

Thereafter, the CPU 41 stands by until the predetermined period (for example, 15 seconds) in which the illumination continues is elapsed, and when the predetermined period is elapsed, the CPU 41 outputs an control signal to the driver 53 to stop driving of the light-emitting diode 52 (step S14). Further, the CPU 41 stops the operation of the regulator 54 (step S15), ending the illumination driving processing.

As described so far, according to the electronic timepiece 40 of this embodiment, when illumination is driven in the same period as wireless communication, illumination is duty-driven. Therefore, even when the light is extinguished at timing of transmitting/receiving a wireless signal, the extinguished state can be made inconspicuous as being hidden among the extinction states in a short cycle due to the duty drive. Therefore, uncomfortable flickering of light can be unrecognizable to a user.

Also, since drive control is carried out to extinguish the illumination during the period of transmitting/receiving a wireless signal, it is possible to avoid an unstable voltage of the battery 55 when the transmitting/receiving operation of a wireless signal happens at the same time as the illumination driving, each of which consumes a large amount of current.

Further, according to the electronic timepiece 40 of this embodiment, when driving the illumination while no communication connection is present, the illumination is driven to be turned on continuously. Hence, in this case, the drive control for the illumination is simplified, thus enabling to reduce necessary control load and excessive consumption of power for the duty drive. Moreover, since a reduced regulator voltage is used while the illumination is continuously driven, the brightness of the illumination can remain at the same level during duty drive and continuous drive of illumination.

Furthermore, in the electronic timepiece 40 of this embodiment, the illumination is driven when a drive request is made from outside, and the timing at which drive request is made is not determined. Therefore, controlling the wireless communication period and the illumination driving period not to overlap with each other is not feasible and thus it is especially useful to have drive control when the wireless communication period and illumination driving period overlap as described above.

Moreover, in the electronic timepiece 40 of this embodiment, the light-emitting diode 52 is used as the illumination device. While the light-emitting diode 52 can have a higher illuminance with respect to power than other illumination devices such as an organic electro luminescence (EL) element, flickering of light is felt more easily because of slight light extinction. Therefore, the aforementioned drive control is especially effective for the electronic timepiece 40 using the light-emitting diode 52.

The present invention is not limited to the foregoing embodiment and various changes and modifications can be made. For example, various types of devices may be applied to the illuminating section including not only super luminosity light-emitting diode but also a normal light-emitting diode, an organic EL element, and so forth. Also, the electronic timepiece is not limited to a wrist watch, and may be any type of timepieces including a stand clock as long as a wireless signal transmission/reception and illumination driving thereof are regarded as large loads.

Further, as described in the embodiment above, as a system for driving illumination, a system may be employed which synchronizes the duty drive cycle and wireless communication cycle so that the transmission/reception period of a wireless signal always overlaps with the off period of the duty drive. Also, duty drive may also be used when the illumination is driven while no wireless communication is present.

The request for driving the illumination may be produced internally at time set for alarm without any operation carried out by a user. Also, the duty drive of the illumination may be controlled by hardware instead of software. In this way, the details of the embodiment described above may be changed as appropriate without departing from the gist of the invention.

The entire disclosure of Japanese Patent Application No. 2011-035317 filed on Feb. 22, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An electronic timepiece comprising:

a timekeeping section which counts time;

a time display section which displays time;

an illuminating section which performs illumination;

a wireless communication section which performs wireless communication by transmitting/receiving a wireless signal intermittently;

a determining section which determines whether the wireless communication section is currently performing the wireless communication;

an operating section which receives an operation command from outside; and a drive control section which performs duty drive of the illuminating section when a drive command is input through the operating section and the determining section determines that the wireless communication section is currently performing wireless communication, and which conducts a drive control so that the illuminating section is extinguished during a period in which a wireless signal is transmitted/received by the wireless communication section.

2. The electronic timepiece according to claim 1, wherein the drive control section drives the illuminating section to perform continuous illumination when the illuminating section is driven during a period in which no wireless communication is performed.

3. The electronic timepiece according to claim 2, wherein the drive control section reduces a driving output during the continuous illumination to be lower than a driving output during the duty drive.

4. The electronic timepiece according to claim 3 wherein the illuminating section is a light-emitting diode.

5. The electronic timepiece according to claim 2 wherein the illuminating section is a light-emitting diode.

6. The electronic timepiece according to claim 1 wherein the illuminating section is a light-emitting diode.

* * * * *